United States Patent [19]

Rainer et al.

[11] 4,079,742

[45] Mar. 21, 1978

[54] PROCESS FOR THE MANUFACTURE OF SYNTHETIC SMOKING MATERIALS

[75] Inventors: Norman B. Rainer, Richmond; Theodore E. Majewski, Bon Air, both of Va.

[73] Assignee: Philip Morris Incorporated, New York, N.Y.

[21] Appl. No.: 734,033

[22] Filed: Oct. 20, 1976

[51] Int. Cl.[2] ..... A24D 1/18

[52] U.S. Cl. ..... 131/2

[58] Field of Search ..... 131/2, 17, 140 R, 140 C, 131/15 C

[56] References Cited

U.S. PATENT DOCUMENTS

| | | | |
|---|---|---|---|
| 2,907,686 | 10/1959 | Siegel et al. | 131/2 |
| 3,548,448 | 12/1970 | Morman et al. | 131/2 |
| 4,014,349 | 3/1977 | Morman et al. | 131/2 |

*Primary Examiner*—Robert W. Michell
*Assistant Examiner*—V. Millin

[57] ABSTRACT

An improved process is provided for the manufacture of synthetic smoking materials. The process comprises the steps of:

(1) Pyrolyzing a cellulosic material at a temperature of from about 150° C to about 400° C, and preferably from about 175° C to about 275° C, under conditions such that from about 8 to about 40% and preferably from about 10 to 25% by weight of the cellulosic material is removed, and (2) Thereafter subjecting the resulting pyrolyzed cellulosic material to extraction with a basic liquid, for example, liquid ammonia, amine or aqueous bases, preferably under conditions to swell the material, whereby from about 15 to about 40%, and preferably from about 20 to about 30%, of the weight of the pyrolyzed product is removed during the extraction.

Both steps should preferably be conducted in such a manner that the overall weight loss of the original cellulosic material is in the range of from about 25 to about 65%, preferably from about 30 to about 50%, whereby the resultant product has a tobacco-like brown color, is not brittle, and has improved smoking characteristics.

6 Claims, No Drawings

PROCESS FOR THE MANUFACTURE OF SYNTHETIC SMOKING MATERIALS

BACKGROUND OF THE INVENTION

Many synthetic smoking products have been described in the art for the purpose of replacing some or all of the tobacco which is conventionally used in smoking products.

Many attempts have been made to utilize cellulosic materials, such as alpha-cellulose, as smoking materials to be used as tobacco replacements or supplements. However, alpha-cellulose and similar materials have, in their untreated form, not been found to be entirely satisfactory materials, either with regard to their burning characteristics or with regard to their smoke properties. Attempts have been made to modify cellulose by oxidative techniques, by heat techniques and by the addition of various materials to modify the properties of the cellulose. Despite these many techniques, cellulose has not been found to be completely satisfactory as a smoking material.

Cellulose has been oxidized by treatment with nitrogen dioxide and similar materials. For example, U.S. Pat. No. 3,461,879 relates to tobacco substitutes in which the combustible portion is oxidized cellulose or is an oxidized material which contains a significant percentage of alpha-cellulose. The theory behind such treatments is believed to involve the oxidation of the primary hydroxyl groups of the cellulose molecule to form carboxyl groups in their place. The oxidation of the cellulose is said to have the effect of reducing the delivery or TPM from the cellulose and to also produce a more desirable taste in the smoke. However, such oxidation, for example with nitrogen dioxide, involves relatively high equipment investment and operation costs and does not produce an entirely satisfactory product.

In addition, various heat treatments have been tried, in attempts to improve the burning properties of cellulose. For example, U.S. Pat. Nos. 3,705,589 and 3,545,448 relate to heat-treated cellulosic materials for use in smoking products. However, the materials produced by such treatments have also not been found to be totally satisfactory.

Some of the synthetic products employ cellulose as a starting material, wherein the cellulose is modified by the addition of certain materials, for example, as is set forth in British Patent 1,113,979.

Compositions which have included certain types of untreated cellulose in combination with other materials, for example, as described in U.S. Pat. No. 3,807,414, have also not been found to provide all of the desired effects.

Other techniques which have been employed have included the heating of cellulosic materials in the presence of a decomposition catalyst in order to obtain a black, brittle material. Furthermore, such black material which has been utilized in powdered form in the manufacture of sheets include chemical binders (for example, as disclosed in South African Patents 73/5352 and 73/5353).

The products which have been made by incorporating various materials in cellulose which has not been thermally treated have not been found to be completely satisfactory in terms of their burning characteristics and in terms of the smoke which is produced upon their combustion.

The products which have involved heating with a decomposition catalyst have also not been completely satisfactory.

The materials involving the oxidation of cellulose to produce oxidized cellulose have been expensive and have produced products which do not resemble tobacco and which have not been found to have totally satisfactory burning characteristics and smoking characteristics.

Other techniques have been described wherein cellulosic materials have been heated at various temperatures in the absence of air. However, these techniques, too, have not provided a totally satisfactory tobacco substitute.

It is also well known in the art that smoking articles may be prepared from a variety of combustible or burnable materials and many materials have been suggested for substitutes or as additives for tobacco. However, such compositions have also not been found to be totally satisfactory.

Many tobacco replacement materials which have been proposed have been made by forming films from slurries or inert and/or combustible materials in combination with synthetic film-forming agents and thereafter cutting or shredding the films to form a smoking product. Various cellulose derivatives, for example, cellulose ethers, such as carboxymethyl cellulose have been suggested for use as the film-forming materials. These cellulose derivatives have been found to differ from cellulose, as well as from pectins or sugars which are naturally present in tobacco. Thus, such cellulose derivatives have been found to introduce new combustion products into the smoke which have not been present in the same amount in conventional tobacco smoke.

Cellulose, itself, is a naturally occurring component of tobacco and is, of course, the main or sole ingredient of the combustible paper wrapper of cigarettes. However, the various items which have been made to utilize cellulose as a smoking material have not been particularly successful, since the quality of the smoke has not been found acceptable unless the cellulose has been subjected to major chemical transformations or has been formulated into compositions with significant amounts of non-cellulosic material. In the instances where the cellulose has been subjected to pyrolytic transformation, the resulting products have often been found to be unsatisfactory in terms of their structure, in terms of being too brittle (for example) to be properly blended with tobacco or to be properly formed into smoking articles. Furthermore, the cellulose which has been produced by pyrolytic transformation has often failed to have the proper smoking properties and burning properties which are desired in the smoking product.

Thus, no completely satisfactory tobacco substitute has been found and it is the object of the present invention to provide an improved smoking product and an improved method of producing the same.

Some of the teachings of the prior art are summarized hereinafter, with patents being presented in numerical order.

U.S. Pat. No. 12,417 relates to the use of cornstalks boiled to make a syrup which is put on leaves of Indian corn as a substitute for tobacco.

U.S. Pat. No. 97,962 relates to the use of eucalyptus leaves using a process of drying, applying hot water or steam, drying, using pressure to crush fibers and then putting into a wrapper to be used as a substitute for tobacco.

U.S. Pat. No. 1,334,752 relates to a fluid for treating tobacco leaves or like plants. The fluid is obtained by boiling resin in a solution of NaCl and by boiling the same in a solution of $NaHCO_3$ and a solution of organic salt of iron.

U.S. Pat. No. 1,680,860 relates to a smokeable tobacco substitute and process using eucalyptus, adding glycerine or honey or molasses as a hydroscopic agent to prevent drying out of the end product. $KNO_3$ is used in an aqueous solution to treat leaves to augment flagration of the end product so that it is made useable for cigarettes and for pipe smoking purposes. The leaves are air dried, crushed between rollers, macerated in $KNO_3$ solution for three hours, drained and put in a pressure vessel at 100°-200° F for 3 hours. The leaves are then compressed and heated up to 212° F, then shredded as filler.

U.S. Pat. No. 2,576,021 teaches that it is known to use wood pulp to make a paper sheet and soak with tobacco extract to make a tobacco substitute and relates to an improvement using fibers of bagasse preferably sugar cane bagasse preferred over wood pulp, cotton, linen, ramie, sisal and other similar fibers because it has a chemical composition similar to tobacco in respect to cellulose, gums, fats and waxes. The process involves washing the sheet and treating it with NaOH or other alkali, and forms a sheet using Fourdrinier equipment. Certain substances can be added to impart desired taste, aroma and color.

U.S. Pat. No. 2,907,686 relates to a tobacco substitute, an elongated cylinder made by charring a piece of wood, to produce charcoal. The wood is charred in the absence of air at 250°-800° C (4-6 hours). The product may include a carrier for flavoring agents, a smoke-forming agent, an ash-forming agent, coating agents, and other materials.

U.S. Pat. No. 2,943,958 relates to tobacco substitutes made from cornsilk and alfalfa. Cornsilk or alfalfa is washed, steamed to leach out solubles (preferably under pressure) and the fibers are treated with aldose, then humidified. The fibers may then be "toasted" at 200°-250° F to brown them.

U.S. Pat. No. 2,943,959 is similar to U.S. Pat. No. 2,943,958 but impregnates the fibers of steamed cornsilk and alfalfa with caffeine. The process involves water washing which may contain a surfactant, e.g. sodium lauryl sulfate or nonylphenoxypolyoxyalkylene glycol, preferably pressure treatment with steam. The materials may contain humectants, e.g. sorbitol, diethylene glycol, triethylene glycol or propylene glycol. Flavoring agents, e.g. vanillin, rum, licorice, and menthol, may also be added.

U.S. Pat. No. 3,034,931 relates to sagebrush as a tobacco substitute. Sagebrush is dried and toasted to a uniform dark color, is also flattened between rollers, is also mixed with materials to enhance color, flavor aroma and burning qualities of the material, e.g. paprika and turmeric, e.g. maple sugar, glycerine, diethylene glycol, e.g. bay leaves, mustard and the like.

U.S. Pat. No. 3,106,209 relates to a tobacco substitute. Vegetable and other leaves, e.g. lettuce, corn, potato, peanut and spinach, are treated with enzymes under controlled humidity. The leaves are treated with $SO_2$ or $NH_3$ at 80°-90° F, then brought to 250° F, crushed and then treated with methyl paraban and papain.

U.S. Pat. No. 3,112,754 relates to a tobacco substitute. Various materials may be deposited on a fibrous medium, such as paper or tobacco leaf or the like. Among the materials which may be added in water (preferred solvent) are: fruit juice, e.g. apple juice, caramelized sucrose, cinnamon, vanilla, cloves, tamar, $KNO_3$ to promote and sustain burning, $CaCO_3$ as a carrier. The fibrous material may be a natural grown product, e.g. tobacco or rice paper (relatively pure cellulose free of taste). The process comprises mixing the materials at 60°-100° C, forming a suspension and, at 20°-30° C, immersing fibrous material in it.

U.S. Pat. No. 3,255,760 relates to a tobacco substitute. A tobacco extract is deposited on paper formed of non-combustible fibers, e.g. glass fibers. Some natural cellulosic fibers, e.g. beaten wood pulp or even some tobacco leaf may be added.

U.S. Pat. No. 3,323,524 relates to a process which treats many types of leaves to remove certain substances. The leaves are extracted with water at 40°-60° C, followed by a bleach rinse and extraction with an organic solvent, e.g. acetone at 40°-65° C.

U.S. Pat. No. 3,369,551 relates to a tobacco substitute base found by extracting plant leaves with water or an organic solvent with many additives listed. Dried materials are toasted to a golden brown color and treated with appropriate additives.

U.S. Pat. No. 3,447,539 relates to a smoking composition which uses oxidized cellulose as a base.

U.S. Pat. No. 3,461,879 relates to a tobacco substitute constituting oxidized cellulose in combination with a hydrated metal compound, for example, magnesium citrate, hydrated alumina, calcium tartrate or magnesium sulfate.

U.S. Pat. No. 3,478,751 relates to a smoking product made from oxidized cellulose subsequently treated with borohydride.

U.S. Pat. No. 3,478,752 relates to a process for oxidizing cellulose. The description of cellulosic material includes alpha-cellulose, rice paper, gums and plant leaves.

U.S. Pat. No. 3,482,578 relates to a smoking product from oxidized cellulose made by treatment with liquid $NO_2$, and then treated with borohydride.

U.S. Pat. No. 3,491,776 relates to the selective oxidation of cellulosic material with $NO_2$.

U.S. Pat. No. 3,512,536 also relates to the selective oxidation of cellulosic material with $NO_2$.

U.S. Pat. No. 3,529,602 relates to a tobacco substitute using tobacco pectins as a film-forming compound.

U.S. Pat. No. 3,545,448 relates to a smoking material comprising a carbohydrate material, such as cellulose, which is thermally degraded at 100°-250° C until a weight loss of at least 10% has occurred, the degradation taking place in the presence of a strong mineral acid catalyst or in the presence of a salt of such strong acid with a weak base. The patent indicates that especially useful carbohydrate materials include alpha-cellulose, cellulose derivatives such as methyl cellulose, various polysaccharides and various gums.

U.S. Pat. No. 3,556,109 relates to a smoking material made from oxidized cellulose with various salts.

U.S. Pat. No. 3,556,110 relates to a smoking material made from oxidized cellulose with various salts.

U.S. Pat. No. 3,559,655 relates to a smoking material made from oxidized cellulose with various salts.

U.S. Pat. No. 3,575,117 relates to a smoking material made by oxidizing cellulosic material with nitrogen dioxide and treating the resulting material with a peroxide.

U.S. Pat. No. 3,577,994 also relates to smoking materials made by the selective oxidation of cellulose.

U.S. Pat. No. 3,608,560 relates to a smoking material made of oxidized cellulose combined with carbon particles.

U.S. Pat. No. 3,612,063 relates to a smoking material made of oxidized cellulose combined with organic salts of potassium, lithium and copper, such as the oxalic, lactic, glycolic, diglycolic, pivalic or tannic acid salts, and with titanium dioxide.

U.S. Pat. No. 3,631,865 relates to a smoking composition comprising tobacco and certain ammonium salts.

U.S. Pat. No. 3,638,660 relates to a tobacco substitute material prepared from fibrous wood pulp containing at least 90% of alpha-cellulose which is lightly beaten to certain specifications and is then formed into a sheet. Various ammonium compounds and other materials, such as magnesium or potassium salts, may be incorporated in the sheet.

U.S. Pat. No. 3,643,668 relates to a smokable product comprising oxidized cellulose and certain aldehydes.

U.S. Pat. No. 3,702,615 relates to a smokable product made from certain plant leaves, such as lettuce, spinach or cabbage, which are treated by a series of steps to improve their burning characteristics.

U.S. Pat. No. 3,720,660 relates to oxidized cellulose and other polysaccharides, wherein the cellulose is reacted with such materials as strong acids, e.g., $H_2SO_4$, with nitrosyl chloride and the like.

U.S. Pat. No. 3,738,374 relates to a tobacco substitute using carbon fibers and an oxidizing agent.

U.S. Pat. No. 3,796,222 relates to a smoking product obtained by treating a slurry of coffee bean hull parts with a reagent, such as diammonium phosphate, to release the pectins contained therein.

U.S. Pat. No. 3,818,915 relates to a smoking product made from a thermally degraded carbohydrate material and containing phenyl acetic acid or 2-phenyl ethanol to mask off notes due to the browning of the carbohydrate.

U.S. Pat. No. 3,874,390 relates to a smokable product formed by heating cellulose to 150°–300° C to obtain a degree of degradation of 5–30% by weight and combining the resulting degraded or carbonized cellulose with an inorganic filler which may be a hydroxide, an oxide or a hydrated oxide of aluminum, iron or silicon, to form a slurry which may then be cast into a sheet for ultimate use as a smoking material.

SUMMARY OF THE INVENTION

An improved process is provided for the manufacture of synthetic smoking materials. The process comprises the steps of:

(1) Pyrolyzing a cellulosic material at a temperature of from about 150° C to about 400° C, and preferably from about 175° C to about 275° C, under conditions such that from about 8 to about 40% and preferably from about 10 to 25% by weight of the cellulosic material is removed, and (2) Thereafter subjecting the resulting pyrolyzed cellulosic material to extraction with a basic liquid, for example, liquid ammonia, amine or aqueous bases, preferably under conditions to swell the material, whereby from about 15 to about 40%, and preferably from about 20 to about 30%, of the weight of the pyrolyzed product is removed during the extraction.

Both steps should preferably be conducted in such a manner that the overall weight loss of the original cellulosic material is in the range of from about 25 to about 65%, preferably from about 30 to about 50%, whereby the resultant product has a tobacco-like brown color, is not brittle, and has improved smoking characteristics.

DETAILED DESCRIPTION OF THE INVENTION

The process of the present invention comprises subjecting a cellulosic material to an initial heat treatment.

The cellulosic materials which may be utilized in the present process include cellulosic materials of natural vegetable origin and which are primarily but not necessarily entirely composed of cellulose. Such materials include wood, preferably in shredded form, such as excelsior, as well as cotton, jute, ramie, sisal, hemp, tree bark and the like. Such materials include the stem, stalk and root structures of various plants which are primarily cellulosic in nature. A particularly preferred material is paper which has been derived from wood pulp. Paper may be described as including structures derived from the suspension of discrete fibrous particles of cellulose in a slurry and the deposition of these particles to form a sheet-like structure which, upon drying, has a cohesive strength due to the physical intertwining of the previously suspended fibrous materials and which has the appearance of functional paper after its deposition and drying. Such papers may be subjected to the heat treatment in the form of sheets or may be shredded, for example, to a dimension suitable for incorporation in a smoking mixture and resembling the dimensions of shredded tobacco. The thickness of the sheet of cellulosic paper which is employed may vary between 0.5 and 1.5 mm prior to the heat treatment.

It has been found that the present process, including both heat treatment and extraction step, may result in dimensional shrinkage of cellulosic shreds of about 20 to about 60%. When shreds or strips are employed as starting materials in the process, they should, preferably, be of such dimensions so that at the end of the process they have a width between 0.3 and 2.0 mm and a length between about 6 and 25 mm. For example, when using alpha-cellulose paper, we prefer to start with paper having the following average dimensions: length, 2–15 cm; width, 0.5–2 mm; and thickness, 0.5–2mm.

The heat treatment should preferably be at a temperature in the range of 150° C to 400° C, and is most preferably at 175° C to 275° C, and should be conducted for sufficient time to result in a weight loss of the cellulosic material in the range of about 8 to about 40%, and preferably in the range of from about 10 to about 25%. The heat treatment is preferably conducted at essentially atmospheric pressure but may be conducted at pressures higher or lower than atmospheric. The time which is normally required for the heat treatment to result in the desired weight loss will generally be from several minutes to several hours, depending upon the specific manner of heating, and the temperature employed.

The heat treatment, especially at temperatures above 240° C, is preferably conducted in an atmosphere which is substantially free of oxidizing agents in order to avoid combustion. For example, it may be conducted in a nitrogen atmosphere or in carbon dioxide, helium, argon or in any suitable inert gas. The gases generated from the heat treatment of the cellulosic material may also be employed for this purpose. Below 240° C, but within the range set forth above, small amounts of oxidizing gases may be present; in fact, at such temperatures air may be used as the atmosphere, although we have noted, when air is used, as compared to nitrogen or other inert gases, that combustion can take place.

We prefer not to conduct the heating above 400° C because of difficulties in carefully controlling the heat treatment to obtain the appropriate weight loss.

As indicated above, the pyrolysis process is preferably carried out under conditions which afford relatively little oxidation. When the pyrolysis is carried out in air, temperatures up to 240° C can be employed without causing the sample to undergo oxidative combustion. At such temperatures, however, the cellulose starting material may have to be heated for several hours in order to achieve satisfactory weight loss due to pyrolysis. More rapid pyrolytic decomposition is achieved at temperatures above 240° C, but at such high temperatures the gaseous environment surrounding the fibers must be essentially non-oxidative. This is achieved by using nitrogen or other inert gases in contact with the cellulose undergoing pyrolysis. At temperatures close to 400° C, and in the presence of inert gases, the cellulose will undergo pyrolytic weight losses greater than 15% within minutes. The crystalline or alpha form of cellulose is more resistant to pyrolytic degradation and therefore requires higher temperature or longer treatment times than cellulosic materials having low alpha content.

It has been found that unless a weight loss of at least 8% is produced during the pyrolysis treatment, the satisfactory results of this invention are not obtained, i.e. the resulting product is not satisfactory because not enough molecular degradation of the cellulose is achieved to produce an improvement in smoking characteristics. For the purpose of the present invention, percent weight loss may be defined as the loss in weight exclusive of the equilibrium moisture content of the starting cellulose. Said equilibrium moisture can range from about 11 to 13%, and is removable by a relatively mild heat treatment at say 100° C. The weight losses expressed in this disclosure are those incurred after removal of said equilibrium moisture.

When the pyrolytic weight loss exceeds 40%, the product develops a brittleness which prevents its satisfactory blending as an integral shred with tobacco shreds. The lost weight which occurs during pyrolysis consists of the gaseous pyrolytic products and aerosolized pyrolytic products or volatile tars. These gases and tars can be recovered and used as fuel to conduct the pyrolysis, or valuable chemical by-products can be isolated from these pyrolytic products.

It has also been discovered that the rate of pyrolytic degradation of the cellulose can be greatly accelerated if the cellulose is subjected to a chemical oxidation treatment prior to pyrolysis. Such oxidative treatment, for example, can be achieved by contacting the cellulose with gaseous $NO_2$ at room temperature or elevated temperatures for periods ranging up to 20 hours. The excess $NO_2$ is preferably removed from the cellulose prior to pyrolytic treatment. Other oxidants which might be employed are ozone, hydrogen peroxide, periodic acid, permanganates or perchlorates. For example, the processes described in U.S. Pat. Nos. 2,472,590, 3,715,268, 3,575,117 and 2,232,900 may be used as a pretreatment.

The pyrolysis can be carried out in a continuous or batchwise operation. The heating equipment employed should preferably possess means for the removal of volatile materials and preferably will also possess means for excluding air or admitting an inert gas.

The heat-treated cellulosic material is, in the second step of the present process, subjected to extraction with a suitable solvent.

The solvent employed in the extraction of the pyrolyzed cellulosic product should comprise a basic compound. The basic compound may be employed in liquid form or may be in aqueous solution. The following compounds are representative of suitable basic solvents: $NH_4OH$, $NR_3$ (R = H or lower alkyl), $C_4H_5N$, $C_4H_4NR$, $C_5H_5N$, $C_5H_4RN$, $C_4H_4N_2$, and $(HOC_2H_4)_3N$. It may be liquid ammonia, or an amine, preferably a water-soluble amine, such as ethanolamine, diethylamine or morpholine, or a quarternary ammonium compound or ammonium hydroxide or an aqueous solution of one or more alkaline substances or a mixture of two or more such materials. For example, the basic liquid may be a water solution of an alkali metal compound, such as NaOH, $Na_2CO_3$, $Na_4SiO_4$, $Na_2B_4O_7$, $Na_3PO_4$, or the corresponding potassium compounds. Some basic compounds which we have found to particularly effective are: $NH_4OH$, $K_2CO_3$, $Na_2CO_3$, $CH_3NH_2$, $(CH_3)_2NH$, $(CH_3)_3N$, $(C_2H_5)_2NH$, $(C_2H_5)_3N$, NaOH, and KOH. $NaHCO_3$ and $KHCO_3$ are also effective. The basic liquid should preferably have a concentration adequate to cause some swelling of the pyrolyzed cellulosic material. Such a concentration will generally be, for the various materials mentioned above, from 1% to 20%. We have found that the swelling has the effect of accelerating the rate of extractive removal of non-volatile tar-like compounds from the pyrolyzed cellulosic material. The preferred extent of swelling should be in the range of from about 30–400%, by volume.

The degree of swelling can be determined by measurement of one of the cross-sectional dimensions of a shred of the material at a magnification of about 100 times. A degree of swelling greater than about 400% is not desirable because it tends to weaken the cellulosic structure. In the case of solvents, such as aqueous NaOH or KOH, suitable concentrations range from about 1–10%. Concentrations in excess of 10% have a tendency to swell the cellulosic structure too much, causing loss of strength of the cellulosic substrate. The extraction removes dark colored tarry substances that form as non-volatile decomposition products of the pyrolysis treatment and impart undesirable aroma to the material during smoking.

The extraction may be carried out in a column operation or by an immersion-type method, in either continuous or batchwise operations. It is preferable to maintain the cellulosic substrate in a quiescent condition to avoid or minimize physical degradation of the cellulosic substrate during extraction.

Following the extraction or washing, the material can be subjected to an acid neutralization treatment. The acid neutralization treatment has the effect of de-swelling the extracted material, and imparts greater strength to the material in its wet form. Suitable neutralizing agents include: HCl, $H_2SO_4$, $H_3PO_4$, and $CH_3OOH$. A preferred agent is HCl. The neutralization should be to a pH of 3 to 7.

The product may then be dried, preferably under conditions which minimize the handling of the materials so as to minimize physical degradation. The acid treated material generally has a lighter color than material not acid treated. The cation of the solvent in some instances becomes attached to the cellulosic substrate by means of salt formation with the carboxyl groups formed in the product by virtue of the pyrolytic treatment of the cellulose. For example, if ammonium hydroxide is employed as the base, ammonium carboxylate groups may be formed and retained by the cellulose-derived smoking material. Similarly, if potassium or sodium bases are utilized, the respective potassium or sodium carboxylate salt groups may form in the smoking material.

We have found that color, flexibility, smoke aroma and burning characteristics of the product are affected by the nature of the solvent employed, and particularly the residual cations remaining in the cellulose-derived material. For example, amine solvents produce light-colored pliable products, liquid ammonia produces a flexible material having improved smoke aroma, and potassium compounds impart controlled flameless burn rate to the material. Other cations, such as $Ca^{++}$, $Mg^{++}$, $Al^{+++}$ can be added to the smoking material either by ion exchange methods which abstract the cation from solvent, or by spray-on methods. The metal cations will affect the appearance of the ash of the smoking material and its smoke aroma. For example, calcium and magnesium residues in the smoking material provide a desirable white, flaky ash. Potassium ions impart evenness of burning.

The product of this invention may be subjected to additional chemical treatments, particularly oxidation and reduction treatments to further modify its characteristics. A modification treatment of particular interest is the controlled degradation of polysaccharide molecular weight by oxidative and/or hydrolytic reactions. Various additives may also be applied to the shredded material or to the material prior to shredding to achieve desired physical properties or burning characteristics. For example, additives include humectants, flavors and compounds which will affect the burn rate or the nature of the resultant ash of the material. Additives which will control the chemical composition of the smoke produced by the burning of the material within the cigarette may also be utilized. Treatment of the material with hydrogen peroxide will cause its color to become lighter in shade. Many additives which have been in use with tobacco for smoking are useful in the present compositions.

The preferred product of this invention is a brown-colored pyrolytic derivative of cellulose in shred form having dimensions comparable to tobacco shreds. The material has a content of pyrolytically derived carboxyl groups in the range of 0.1–1.0 meq/g and has a surface area greater than 0.5 $m^2/g$. The shreds have a flexibility, even without the addition of special flexibilizing additives, greater than the flexibility of a fully carbonized shred of the same dimensions and physical characteristics. The moisture regain of the material at 24° C and 65% RH, is generally less than 10%. In a preferred embodiment, the product has the internal geometrical configuration of a pulp-derived paper structure. In some applications, it may be found desirable to use the product of this invention as a feed stock for a pulper or other apparatus for formulating a blended smoking product composition.

For the purposes of the present invention, the carboxyl group content of the treated tobacco may be determined by the titration method of Unruh and Kenyon (J. Am. Chem. Soc. 64, 127 (1942)), which involves treatment of the sample with a solution of calcium acetate, followed by titration of the liberated acetic acid. For the carboxyl group analysis to be meaningful, the smoking material must first be thoroughly extracted by the process of this invention, because the extractible tars are acidic in themselves. The material must also be in the acidic form and thoroughly washed to remove any free acid. The carboxyl content can alternatively be determined by the analysis of cation species in ion-exchanged and thoroughly washed species of the smoking material. Thus, for example, a nitrogen analysis may be adequate in the case of the ammonium salt form of the material.

The shredded smoking material has a stiffness preferably greater than tobacco shreds, and tends to increase the filling power of blends with tobacco. The filling power, or the ability of the shredded material to fill a cigarette wrapper, may be measured by placing a weighed quantity of the shredded material in a graduated glass cylinder, and compressing the material with a close fitting weighted plunger. The extent of compression of the material is a measure of the filling power of the sample. The product of this invention, in a 20% blend with shredded tobacco, will increase the filling power of the blend at least 5%.

The present invention provides a smoking material derived substantially entirely from cellulose. It also provides a process for converting a cellulosic paper into a smoking material which can be satisfactorily blended with tobacco to provide an acceptable cigarette. It further provides a smoking material, pyrolytically derived from cellulose, which does not require binder to achieve physical integrity.

We have found by differential thermal analysis, that there is a consistent distinction between pure cellulose and the product of our invention; namely, that in the 350–360° C region, the latter shows an exotherm while cellulose shows an endotherm.

The following examples are illustrative:

EXAMPLE 1

A paper made of flax pulp, and having a thickness of about 1 mm, was shredded to provide shreds having an average width of 1 mm, and average length of 120 mm. The shredded material was placed in an air-circulating oven maintained at a temperature of 225° C. After 15 hours, the weight loss of the shreds was 13.5%, and the material possessed a light brown color.

The heat-treated material was then placed in a glass column and extracted by a downward flow of concentrated $NH_4OH$ at room temperature. Extraction was continued until the effluent was essentially colorless. The extracted material was then dried in a vacuum oven at 80° C. The weight loss of the material incurred by the ammonia extraction is 27.3% of the weight of the pyrolyzed but unextracted material. The overall weight loss of the product, based upon the dry weight of the starting paper, was 37.1%. The product contained 0.60 meq/g of carboxyl groups.

The material was soaked for 12 hours in 15% aqueous calcium acetate solution. The solution was then decanted, and the product was washed extensively with distilled water. The purpose of this treatment was to convert the carboxyl groups on the product to the calcium salt form. The material was dried and utilized for the production of cigarettes having 100% of the material, and cigarettes wherein the material was blended with 50% of a regular commercial tobacco.

The cigarettes made from 100% of the material of this example were adjudged to be far superior to a comparable cigarette made from the untreated cellulose starting material. In the case of the 50% blend cigarettes, it was difficult to distinguish between the cigarettes containing the material of this example, and a control cigarette consisting of 100% of the tobacco used for the 50% blend.

EXAMPLE 2

153.0 g of shredded alpha-cellulose paper (Buckeye Cellulose Corp., Memphis Tenn., type V-90 N) (1 mm × 120 mm) was placed on an aluminum tray and heated in an air circulating oven at approximately 240° C until a weight loss of 37.0 grams (24.2%) was obtained.

50.0 grams of the heat-treated material was placed in a column containing a fritted glass disc at the bottom and fitted with a stopcock. The material was covered with concentrated $NH_4OH$ and allowed to stand at room temperature until the $NH_4OH$ became dark. The solution was drained and fresh concentrated $NH_4OH$ added to the column. These changes were continued until a weight loss of about 18.6% (9.3 g) was obtained. The total weight loss, based on the starting alpha-cellulose, was 40.7%. The extracted material was washed well with water to remove any residual $NH_4OH$ and then washed with acetone to remove water. The material was dried in a vacuum oven at room temperature. The extracted material was found to contain 0.7 meq/g of carboxyl groups.

Shreds having the approximate size of regular shredded tobacco were provided from the untreated cellulose, the heat-treated cellulose (24.2% weight loss) and the heat-treated cellulose extracted with concentrated $NH_4OH$ (40.7% weight loss). Each of these was then mixed with regular tobacco filler at a 20% weight concentration.

Cigarettes were made from these three fillers using the R.Y.O. Filtermatic cigarette maker manufactured by Sutliff Tobacco Co., Richmond, Va. The cigarettes, containing 1.0 gram of filler, were 85 mm long and were provided with a 20 mm cellulose acetate filter.

A panel of five persons trained to discern differences in qualitative characteristics of cigarette smoke found the cigarette containing the heat-treated, $NH_4OH$-extracted alpha-cellulose, to not differ in subjective response from a conventional cigarette. By comparison, the cigarette containing alpha-cellulose gave a woody note; the cigarette containing the heat-treated alpha-cellulose gave a pungent note. These subjective responses were not found with the cigarette containing the heat-treated $NH_4OH$-extracted alpha-cellulose.

EXAMPLE 3

Some 1 mm-thick sheets of cellulose paper having alpha-cellulose content of 85% (Buckeye Cellulose Corp., Memphis, Tenn., type P-13) were placed in a 4-mil polyethylene bag which was then filled with $NO_2$ gas. After 24 hours at room temperature, the bag was opened and the $NO_2$ was vented off. The treated sheets were then placed in an air-circulating oven at 225° C. In 1 hour, the sheets lost 19% of their initial weight. The oven temperature was raised to 233° C, and after 1½ hours at this temperature, the sheets registered a total weight loss of 27%. The sheets had a brown color, somewhat darker than tobacco.

The brown sheets were shredded to provide shreds having an average width of 1 mm and an average length of 75 mm. The shredded material was placed in a vertical glass column, to which was added 3% aqueous KOH. The shreds were allowed to remain in contact with the alkaline solution for 24 hours at room temperature and the solution was then drained off. This extraction treatment was repeated a second time, and the shreds were then washed with a flow of distilled water, and dried. The weight loss due to the extraction was 28% of the weight of material initially placed in the column for extraction. The moisture regain of this material was 8% at 24° C and 65% R.H. The acidity of the material was 0.6 meq/g.

The product had a dark brown color and exhibited a satisfactory flameless burn rate. The smoke produced by the material had a considerably less pungent aroma than smoke produced from the untreated starting material.

The smoking material of this example was spray-treated with an aqueous solution containing glycerine and flavors to provide an add-on of 5% (neat) and was blended with an equal weight of shredded tobacco. Blending was accomplished by vigorously shaking the mixture in a plastic bag. When the fine material at the bottom of the bag was examined, approximately equal amounts of tobacco and substitute smoking material were found. This indicates that the substitute smoking material not only remains suspended in the tobacco, but that it is resistant to attritional degradation by physical handling.

Handmade cigarettes fabricated from the blend were adjudged to have satisfactory flavor characteristics. The smoke was also found to deliver about 10% less tar than the all-tobacco control cigarette made and smoked in the same manner.

EXAMPLE 4

Shredded alpha-cellulose paper (Buckeye Cellulose Corp., Memphis, Tenn., Type V-90N) was heated at 390° C. in a stream of nitrogen to obtain a weight loss of 24.2%. The heat-treated shreds were placed in a glass column and were treated with a downwardly flowing stream of 7% aqueous KOH. The initial effluent from the column was black in color. Extraction was continued until the effluent was almost colorless.

The shreds in the column were then washed with distilled water, dried, and allowed to re-equilibrate to normal moisture regain before weighing. The weight of material extracted was 35% of the weight of the shreds placed in the column. The total weight loss of the initial cellulose is therefore 50.8%.

The extracted shreds were blended at the 50% level with shredded tobacco, and the blend was utilized for the production of machine-made cigarettes. It was found that, when the cigarettes were made to a standard acceptable firmness, 12% less weight of filler was required utilizing the blend of this example in comparison with cigarettes made to the same firmness from the tobacco alone. This is a consequence of the increased filling power of the smoking material of this invention.

EXAMPLE 5

Some fine grade excelsior cut from Virginia Loblolly pine was treated with $NO_2$ gas at 25° C for 12 hours. The excelsior was then heated at 170° C until a weight loss of 8.5% was obtained.

The heat-treated excelsior wa then extracted with aqueous 8% $K_2CO_3$ solution until a weight loss of 21% was obtained. The material was then washed with water, treated with 5% HCl and then washed again with distilled water. The resultant dried material had 0.4 meq/g of carboxyl groups. It was then soaked in an aqueous solution of calcium hydroxide to convert the carboxyl groups to the calcium salt form. The material was again washed with distilled water to remove any excess calcium hydroxide solution.

The smoking material was then sprayed with an aqueous solution containing 3% glycerin, 3% flavors and 1% potassium phosphate to a 100% add-on, and was then dried to 15% moisture content. This material was blended with shredded tobacco to form a stable blend containing 30% of the substitute smoking material. The blend was utilized for the production of machine-made cigarettes.

The smoking qualities of the cigarettes containing the smoking material of this invention were adjudged by a panel of 10 experienced smokers to be comparable to control cigarettes consisting entirely of tobacco.

EXAMPLE 6

Shreds of a cellulose paper containing 85% alpha-cellulose were heated to 240° C for 15 hours in an air-circulating oven to provide a 34% weight loss.

The material was then extracted with liquid ammonia, which caused a swelling of the shreds of about 2.7 times the initial width. About 16% of weight was extracted from the shreds by the liquid ammonia.

The resultant material was more resilient and non-dusting than similarly pyrolyzed materials extracted with other solvents; this is thought to be due to a redeposition of some of the soluble tar on the periphery of the shreds, where it acts as a binder.

The shreds exhibited a very satisfactory smoke aroma.

Some of the shred material was re-immersed in liquid ammonia containing 5% dissolved benzaldehyde, and removed after 3 minutes of immersion. It was found that the shreds contained 2% of durably entrapped benzaldehyde. The benzaldehyde is released when the shreds are wetted with water or burned.

Cigarettes were fabricated from a 50/50 blend of the smoking material of this example and shredded tobacco. Upon smoking, the cigarettes were found to deliver acceptable quality smoke. The benzaldehyde-containing material imparted a pleasant, cherry-like overtone to the smoke flavor.

EXAMPLE 7

A shredded flax paper was treated with $NO_2$ gas at 22° C for 12 hours, then washed with water, dried and subjected to pyrolysis at 400° C in a nitrogen atmosphere. A weight loss of 25% was obtained in about 3 minutes.

The material was then placed in a vertical column containing monoethanolamine. After standing in contact with the monoethanolamine for 24 hours, the shreds expanded to about 2.2 times their original size. The shreds were then extracted with a continuous flow of the amine through the stationary bed of shredded material. Following washing and drying, the shreds were found to have lost about 24% of their initial weight by virtue of the extraction treatment.

The shredded smoking material possessed a very light brown color and was very flexible. The material formed stable blends with tobacco, from which cigarettes were made having acceptable smoking characteristics.

What is claimed is:

1. An improved process for the manufacture of synthetic smoking materials comprising the steps of:

(1) Pyrolyzing a cellulosic material at a temperature of from about 150° C to about 400° C under conditions such that the cellulosic material undergoes a weight loss from about 8 to about 40% by weight, and (2) Thereafter subjecting the resulting pyrolyzed cellulosic material to extraction with a basic liquid at a temperature of 0° to 150° C and a pressure of 1 to 100 psia for sufficient time so that from about 15 to about 40% of the weight of the pyrolyzed product is removed during the extraction and conducting both steps in such a manner that the overall weight loss of the original cellulosic material is in the range of from about 25 to about 65%.

2. An improved process for the manufacture of synthetic smoking materials comprising the steps of:

(1) Pyrolyzing a cellulosic material at a temperature of from about 150° C to about 400° C under conditions such that from about 8 to about 40% by weight of the cellulosic material is removed, and (2) Thereafer subjecting the resulting pyrolyzed cellulosic material to extraction with a basic liquid selected from the group consisting of: water-soluble amines and quarternary ammonium bases, liquid ammonia, ammonium hydroxide, and aqueous solutions of basic inorganic compounds at a temperature of 0° to 150° C and a pressure of 1 to 100 psia for sufficient time so that from about 15 to about 40% of the weight of the pyrolyzed product is removed during the extraction and conducting both steps in such a manner that the overall weight loss of the original cellulosic material is in the range of from about 25 to about 65%.

3. An improved process for the manufacture of synthetic smoking materials comprising the steps of:

(1) Pyrolyzing a cellulosic material at a temperature of from about 150° C to about 400° C under conditions such that from about 8 to about 40% by weight of the cellulosic material is removed, (2) Thereafter subjecting the resulting pyrolyzed cellulosic material to extraction with a basic liquid at a temperature of 0° to 150° C and a pressure of 1 to 100 psia for sufficient time so that from about 15 to about 40% of the weight of the pyrolyzed product is removed during the extraction, and (3) Thereafter neutralizing the resulting pyrolyzed and extracted cellulosic material, and conducting steps (1) and (2) in such a manner that the overall weight loss of the original cellulosic material is in the range of from about 25 to about 65%.

4. The process of claim 3, wherein said cellulosic material is in the form of paper.

5. The process of claim 4, wherein said paper is in the form of shreds having a length greater than 1 cm and a cross-sectional diameter greater than 0.5 mm.

6. The product formed by the process of claim 1.

* * * * *